US011795978B2

(12) United States Patent
Nault et al.

(10) Patent No.: US 11,795,978 B2
(45) **Date of Patent: *Oct. 24, 2023**

(54) ACCUMULATOR SYSTEM

(71) Applicant: SCHLUMBERGER TECHNOLOGY CORPORATION, Sugar Land, TX (US)

(72) Inventors: Christopher Nault, Houston, TX (US); Matthew David Givens, Houston, TX (US); Vikas Rakhunde, Cypress, TX (US); Stephen McGuire, Hockley, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/820,910

(22) Filed: Aug. 19, 2022

(65) Prior Publication Data

US 2022/0389941 A1 Dec. 8, 2022

Related U.S. Application Data

(63) Continuation of application No. 16/787,536, filed on Feb. 11, 2020, now Pat. No. 11,441,579, which is a (Continued)

(51) Int. Cl.
*F15B 1/24* (2006.01)
*E21B 33/064* (2006.01)
(Continued)

(52) U.S. Cl.
CPC ..... *F15B 1/24* (2013.01); *E21B 33/0355* (2013.01); *E21B 33/064* (2013.01)

(58) Field of Classification Search
None
See application file for complete search history.

(56) References Cited

U.S. PATENT DOCUMENTS 5,505,426 A 4/1996 Whitby et al.
6,202,753 B1 3/2001 Baugh
(Continued)

FOREIGN PATENT DOCUMENTS

EP 2917461 A1 9/2015
EP 3502410 A1 6/2019
(Continued)

OTHER PUBLICATIONS

Quantum Leap Technologies, Integrated Power Solutions, https://www.qltech.net/, Westhill, UK, 2019.
(Continued)

*Primary Examiner* — Matthew R Buck
*Assistant Examiner* — Douglas S Wood
(74) *Attorney, Agent, or Firm* — Kelly McKinney

(57) ABSTRACT

An accumulator system includes a chamber configured to receive a first fluid, a piston configured to move within the chamber to pressurize and drive the first fluid out of the chamber, a driving shaft coupled to the piston, a screw adapter coupled to the driving shaft, a plurality of anti-rotation shafts, and an electric actuator configured to couple to the screw adapter and to rotate the screw adapter to axially move the driving shaft. The piston includes a body defining a first aperture and a plurality of counterbores. The driving shaft is coupled to the piston via the first aperture. The piston is configured to slide over the plurality of anti-rotation shafts via the plurality of counterbores.

19 Claims, 10 Drawing Sheets

Related U.S. Application Data continuation-in-part of application No. 16/543,738, filed on Aug. 19, 2019, now Pat. No. 11,624,254.

(60) Provisional application No. 62/719,455, filed on Aug. 17, 2018.

(51) Int. Cl.

| | |
|---|---|
| ***E21B 33/035*** | (2006.01) |
| *E21B 33/06* | (2006.01) |
| *F15B 1/04* | (2006.01) |

(56) References Cited

U.S. PATENT DOCUMENTS

| | | | | |
|---|---|---|---|---|
| 6,234,771 | B1 | 5/2001 | Carey et al. | |
| 6,998,724 | B2 | 2/2006 | Johansen et al. | |
| 7,137,450 | B2 | 11/2006 | Johansen et al. | |
| 7,156,183 | B2 * | 1/2007 | Williams | E21B 34/16 166/386 |
| 7,159,662 | B2 | 1/2007 | Johansen et al. | |
| 7,520,129 | B2 | 4/2009 | Springett | |
| 7,878,244 | B2 * | 2/2011 | Nold, III | E21B 49/10 166/264 |
| 8,651,190 | B2 | 2/2014 | Dietz | |
| 8,657,011 | B2 | 2/2014 | Vyas et al. | |
| 8,784,074 | B2 | 7/2014 | Davey et al. | |
| 9,140,090 | B2 | 9/2015 | Van Wijk et al. | |
| 9,222,326 | B2 | 12/2015 | Whitby et al. | |
| 9,388,888 | B2 | 7/2016 | Eriksen | |
| 9,494,007 | B2 | 11/2016 | Bourgeau et al. | |
| 9,587,455 | B2 | 3/2017 | Frey et al. | |
| 9,627,940 | B2 | 4/2017 | Eriksen | |
| 9,822,600 | B2 | 11/2017 | Bourgeau et al. | |
| 9,885,221 | B2 | 2/2018 | Baugh | |
| 9,957,768 | B2 | 5/2018 | Van Wijk et al. | |
| 10,132,135 | B2 | 11/2018 | Gaude | |
| 10,316,605 | B2 | 6/2019 | Bourgeau et al. | |
| 10,365,669 | B2 | 7/2019 | Groves et al. | |
| 10,801,292 | B2 | 10/2020 | Biester et al. | |
| 10,851,805 | B2 | 12/2020 | Thomson et al. | |
| 10,975,891 | B2 | 4/2021 | Afshari | |
| 11,060,372 | B2 | 7/2021 | Bourgeau et al. | |
| 11,441,479 | B2 * | 9/2022 | Richards | F16D 27/04 |
| 11,441,579 | B2 * | 9/2022 | Nault | F15B 1/04 |
| 2011/0147002 | A1 * | 6/2011 | Kotrla | E21B 33/0355 166/363 |
| 2013/0019980 | A1 | 1/2013 | Baugh | |
| 2013/0283919 | A1 | 10/2013 | Coonrod et al. | |
| 2014/0027105 | A1 | 1/2014 | Irani | |
| 2014/0166264 | A1 | 6/2014 | Judge et al. | |
| 2014/0219848 | A1 * | 8/2014 | Rabhi | F03C 1/047 418/24 |
| 2014/0325974 | A1 | 11/2014 | Schulz et al. | |
| 2015/0104328 | A1 | 4/2015 | Babbitt et al. | |
| 2015/0211504 | A1 | 7/2015 | Dieringer et al. | |
| 2017/0145773 | A1 * | 5/2017 | van Wijk | E21B 33/0355 |
| 2018/0347304 | A1 | 12/2018 | Alalasundaram et al. | |
| 2019/0003275 | A1 | 1/2019 | Deul et al. | |
| 2019/0203739 | A1 | 7/2019 | Afshari | |
| 2019/0218879 | A1 | 7/2019 | Biester et al. | |
| 2020/0056630 | A1 | 2/2020 | Nault et al. | |
| 2020/0072012 | A1 | 3/2020 | Angstmann et al. | |
| 2020/0173465 | A1 | 6/2020 | Nault et al. | |
| 2020/0284274 | A1 * | 9/2020 | van Kuilenburg | E21B 33/062 |
| 2020/0408058 | A1 * | 12/2020 | Pedersen | E21B 33/0355 |

FOREIGN PATENT DOCUMENTS

| | | | |
|---|---|---|---|
| WO | 2012140178 | A1 | 10/2012 |
| WO | 2017042152 | A1 | 3/2017 |
| WO | 2017062040 | A1 | 4/2017 |

OTHER PUBLICATIONS

Combined Search and Examination Report issued in UK Patent Application 1911857.9 dated Jan. 17, 2020, 5 pages.

International Search Report and Written Opinion issued in International Patent Application No. PCT/US2021/017651 dated Jun. 4, 2021; 10 pages.

Quam SC-SSV control line blow out preventer product sheet, QUAM, accessed via https://www.iamquam.it/Control-Line-Blowout-Preventer.php on Feb. 25, 2022, 2 pages.

Final Rejection issued in U.S. Appl. No. 16/543,738 dated Mar. 14, 2022, 14 pages.

International Preliminary Report on Patentability issued in the PCT Application No. PCT/US2021/017651 dated Aug. 25, 2022, 7 pages.

Non-Final Rejection issued in U.S. Appl. No. 16/543,738 dated Aug. 19, 2022; 9 pages.

International Search Report and Written Opinion issued in International Patent Application No. PCT/US2023/064056 dated Jul. 19, 2023, 10 pages.

* cited by examiner

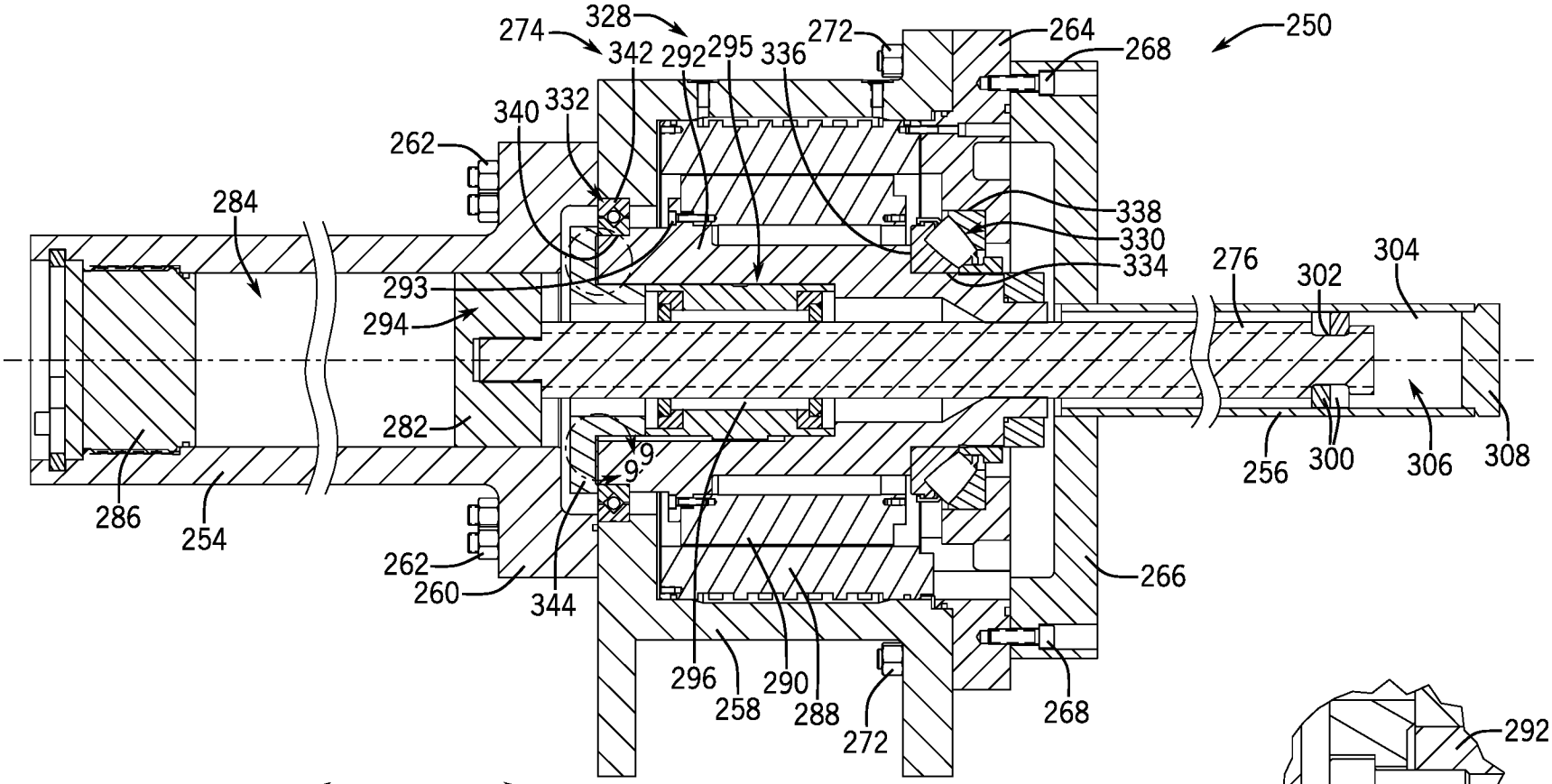
FIG. 8
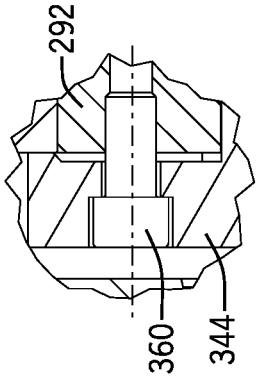
FIG. 9
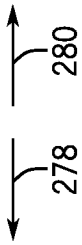

ACCUMULATOR SYSTEM

BACKGROUND

This application is a continuation application and claims priority from and the benefit of U.S. application Ser. No. 16/787,536, entitled "Accumulator System," filed Feb. 11, 2020, which is herein incorporated by reference in its entirety for all purposes, which is a continuation-in-part application and claims priority from and the benefit of U.S. application Ser. No. 16/543,738, entitled "Accumulator System," filed Aug. 19, 2019, which is herein incorporated by reference in its entirety for all purposes, which claims priority and the benefit of U.S. Application Ser. No. 62/719,455, entitled "Force Driven Accumulator," filed Aug. 17, 2018, which is herein incorporated by reference in its entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Once a desired subterranean resource is discovered, drilling and production systems are employed to access and extract the resource. These systems may be located onshore or offshore depending on the location of the desired resource. Such systems generally include a wellhead assembly through which the resource is extracted. These wellhead assemblies may include a wide variety of components, such as various casings, valves, fluid conduits, that control drilling or extraction operations.

Deepwater accumulators provide a supply of pressurized working fluid for the control and operation of sub-sea equipment, such as through hydraulic actuators and motors. Typical sub-sea equipment may include, but is not limited to, blowout preventers (BOPs) that shut off the well bore, gate valves for flow control of oil or gas, electro-hydraulic control pods, or hydraulically-actuated connectors and similar devices.

SUMMARY

Certain aspects of some embodiments disclosed herein are set forth below. It should be understood that these aspects are presented merely to provide the reader with a brief summary of certain forms the disclosure might take and that these aspects are not intended to limit the scope of the disclosure. Indeed, the disclosure may encompass a variety of aspects that may not be set forth below.

In one example, an accumulator system that includes a housing. The housing defines a function chamber and a balance chamber. A piston moves axially within the housing. The piston separates the function chamber from the balance chamber. An electric actuator couples to and drives the piston within the housing to compress and drive a first fluid out of the function chamber.

In another example, a mineral extraction system that includes a mineral extraction component. An accumulator system couples to the mineral extraction component. The accumulator system pressurizes a fluid to actuate the mineral extraction component. The accumulator system includes a housing. The housing defines a function chamber and a balance chamber. A piston moves axially within the housing. The piston separates the function chamber from the balance chamber. An electric actuator couples to and drives the piston within the housing to compress and drive a first fluid out of the function chamber.

In another example, an accumulator system that includes a cylinder that receives a first fluid. An actuator housing couples to the cylinder. A piston moves within the cylinder to pressurize and drive the first fluid out of the cylinder. A shaft couples to the piston. A screw adapter couples to the shaft. An electric motor couples to the screw adapter. The electric motor rotates the screw adapter to axially move the shaft.

According to one or more embodiments of the present disclosure, an accumulator system includes a chamber configured to receive a first fluid; a piston configured to move within the chamber to pressurize and drive the first fluid out of the chamber, wherein the piston includes a body defining: a first aperture; and a plurality of counterbores, a driving shaft coupled to the piston via the first aperture; a screw adapter coupled to the driving shaft; a plurality of anti-rotation shafts; and an electric actuator configured to coupled to the screw adapter, wherein the electric actuator is configured to rotate the screw adapter to axially move the driving shaft, wherein the piston is configured to slide over the plurality of anti-rotation shafts via the plurality of counterbores.

A method according to one or more embodiments of the present disclosure includes: coupling an accumulator system to a mineral extraction component, the accumulator system comprising: a housing; a piston separating the housing into a first chamber and a second chamber; an electric actuator; a shaft coupled to the piston and to the electric actuator; and an anti-rotation system; storing a first fluid in the first chamber at ambient pressure; rotating the electric actuator, creating rotary motion; transforming the rotary motion into linear motion of the shaft, which drives the piston; pressurizing the first fluid and driving the first fluid out of the accumulator system using the piston; and actuating the mineral extraction component using the first fluid.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 8 is a cross-sectional view of the accumulator system of FIG. 7 along line 8-8, in accordance with an embodiment of the present disclosure;

FIG. 9 is a partial cross-sectional view of the accumulator system within line 9-9 of FIG. 8, in accordance with an embodiment of the present disclosure;

DETAILED DESCRIPTION OF SPECIFIC EMBODIMENTS

Figure 1:
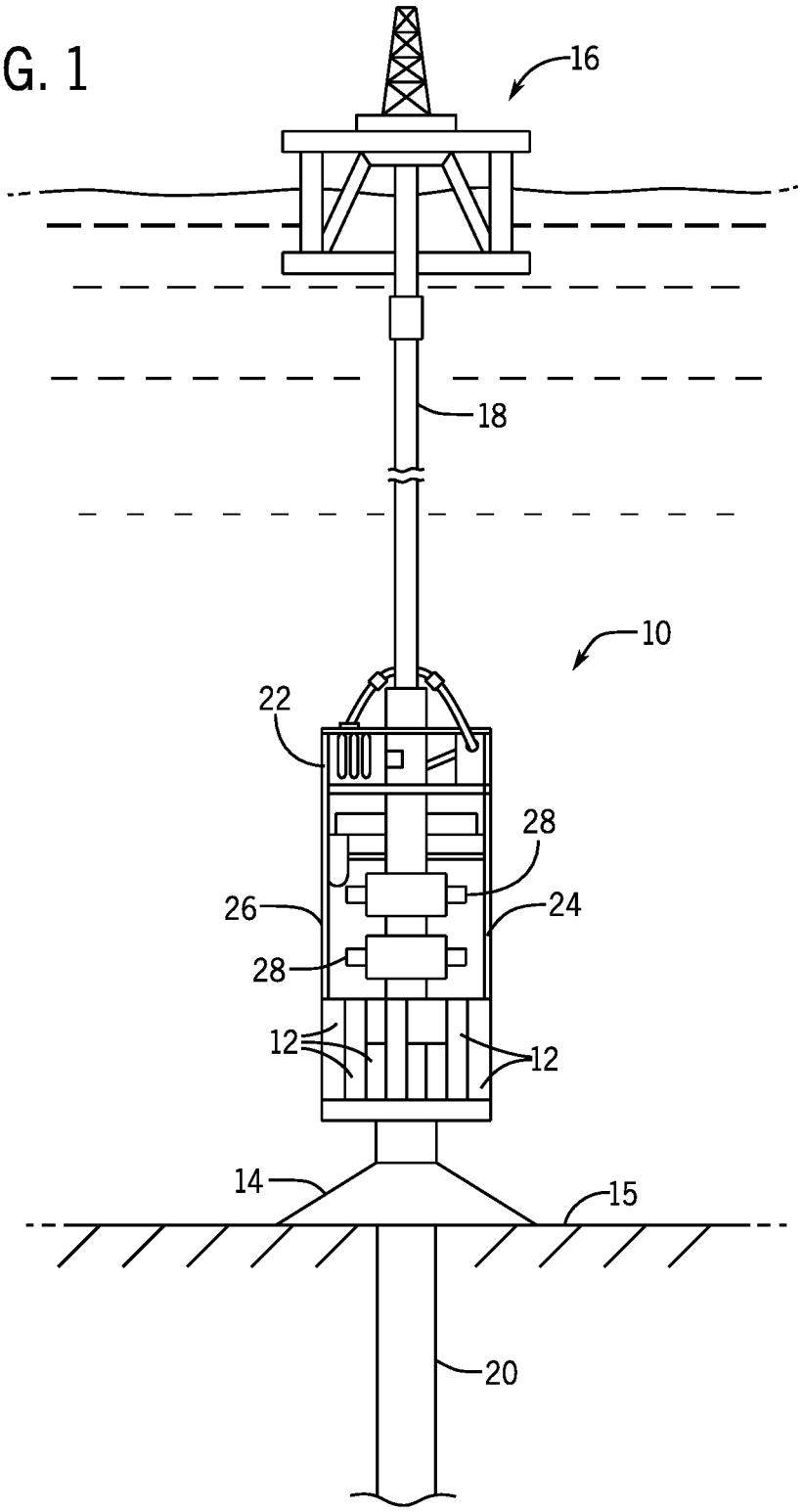
FIG. 1 is a schematic of a sub-sea BOP stack assembly having one or accumulator systems, in accordance with an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Typical accumulators may be divided into a gas section and a hydraulic fluid section that operate on a common principle. The general principle is to pre-charge the gas section with pressurized gas to a pressure at or slightly below the anticipated minimum pressure to operate the sub-sea equipment. Fluid can be added to the accumulator in the separate hydraulic fluid section, compressing the gas section, thus increasing the pressure of the pressurized gas and the hydraulic fluid together. The hydraulic fluid introduced into the accumulator is therefore stored at a pressure equivalent to the pre-charge pressure and is available for doing hydraulic work. However, gas-charged accumulators used in sub-sea environments may undergo a decrease in efficiency as water depth increases. This loss of efficiency is due, at least in part, to an increase of hydrostatic stress acting on the pre-charged gas section, which provides the power to the accumulators through the compressibility of the gas.

The pre-charge gas can be said to act as a spring that is compressed when the gas section is at its lowest volume and greatest pressure, and released when the gas section is at its greatest volume and lowest pressure. Accumulators may be pre-charged in the absence of hydrostatic pressure and the pre-charge pressure may be limited by the pressure containment and structural design limits of the accumulator vessel under surface ambient conditions. Yet, as described above, as accumulators are used in deeper water, their efficiency decreases as application of hydrostatic pressure causes the gas to compress, leaving a progressively smaller volume of gas to charge the hydraulic fluid. The gas section must consequently be designed such that the gas still provides enough power to operate the sub-sea equipment under hydrostatic pressure even as the hydraulic fluid approaches discharge and the gas section is at its greatest volume and lowest pressure.

For example, accumulators at the surface may provide 3,000 psi (pounds per square inch) maximum working fluid pressure. In 1,000 feet of seawater, the ambient pressure is approximately 465 psi. Therefore, for an accumulator to provide a 3,000 psi differential at the 1,000 foot depth, it must actually be pre-charged to 3,000 psi plus 465 psi, or 3,465 psi. At slightly over 4,000 feet water depth, the ambient pressure is almost 2,000 psi. Therefore, the pre-charge would be required to be 3,000 psi plus 2,000 psi, or 5,000 psi. In others words, the pre-charge would be almost double the working pressure of the accumulator. Thus, at progressively greater hydrostatic operating pressures, the accumulator has greater pressure containment requirements at non-operational (e.g., no ambient hydrostatic pressure) conditions.

Given the limited structural capacity of the accumulator to contain the gas pre-charge, operators of this type of equipment may be forced to work within efficiency limits of the systems. For example, when deep water systems are required to utilize hydraulic accumulators, operators will often add additional accumulators to the system. Some accumulators may be charged to 500 psi, 2,000 psi, 5,000 psi, or higher, based on system requirements. As the equipment is initially deployed in the water, all accumulators may operate normally. However, as the equipment is deployed in deeper water (e.g., past 1,000 feet), the accumulators with the 500 psi pre-charge may become inefficient due to the hydrostatic compression of the gas charge. Additionally, the hydrostatic pressure may act on all the other accumulators, decreasing their efficiency. The decrease in efficiency of the sub-sea gas charged accumulators decreases the amount and rate of work which may be performed at deeper water depths. As such, for sub-sea equipment designed to work beyond 5,000 foot water depth, the amount of gas charged accumulators may be increased by 5 to 10 times. The addition of these accumulators increases the size, weight, and complexity of the sub-sea equipment.

Conversely, the disclosed embodiments do not rely on gas to provide power to a working fluid. Rather, the accumulator systems include an electric actuator that drives a piston to pressurize a working fluid that then actuates one or more mineral extraction system components (e.g., blowout preventer). This means that the accumulator systems discussed below may not experience a loss in efficiency due to water depth. Additionally, the accumulator systems discussed below vary pressure output since the electric actuator may be controlled in response to pressure demands of the mineral extraction system or component.

FIG. 1 depicts a sub-sea BOP stack assembly 10, which may include one or more accumulator systems 12 that power one or more components on the sub-sea BOP stack assembly 10. As illustrated, the BOP stack assembly 10 may be assembled onto a wellhead assembly 14 on the sea floor 15. The BOP stack assembly 10 may be connected in line between the wellhead assembly 14 and a floating rig 16 through a sub-sea riser 18. The BOP stack assembly 10 may provide emergency fluid pressure containment in the event that a sudden pressure surge escapes the well bore 20. Therefore, the BOP stack assembly 10 may be configured to prevent damage to the floating rig 16 and the sub-sea riser 18 from fluid pressure exceeding design capacities. The BOP stack assembly 10 may also include a BOP lower marine riser package 22, which may connect the sub-sea riser 18 to a BOP package 24.

In certain embodiments, the BOP package 24 may include a frame 26, BOPs 28, and accumulator systems 12, which may be used to provide hydraulic fluid pressure for actuating the BOPs 28. The accumulator systems 12 may be incorporated into the BOP package 24 to maximize the available space and leave maintenance routes clear for working on components of the sub-sea BOP package 24. The accumulator systems 12 may be installed in parallel where the failure of any single accumulator system 12 may prevent the additional accumulator systems 12 from functioning.

Figure 2:
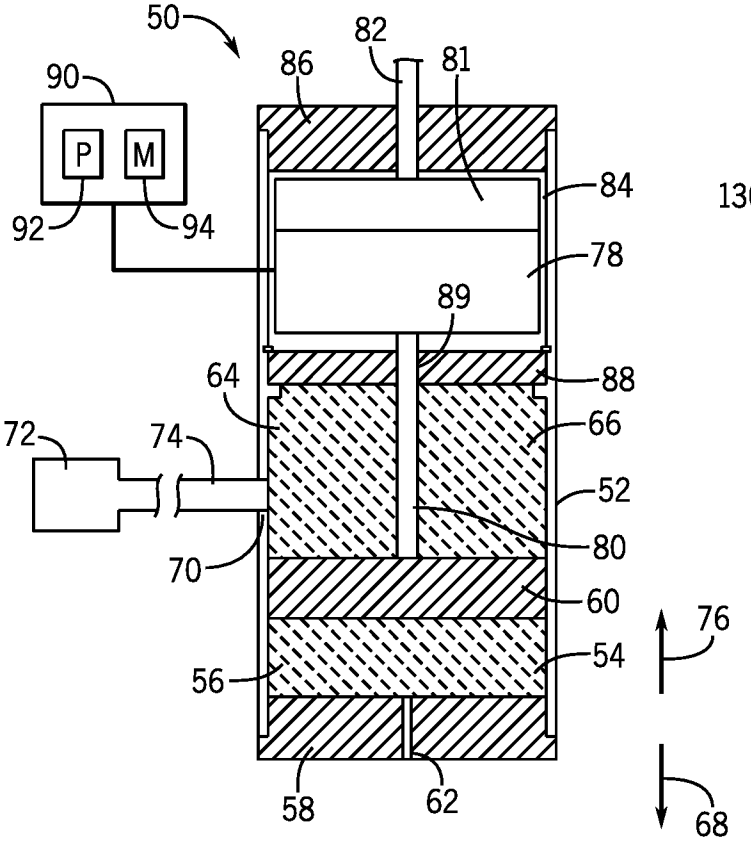
FIG. 2 is a schematic of an accumulator system, in accordance with an embodiment of the present disclosure.

FIG. 2 is a schematic of an accumulator system 50. The accumulator system 50 includes a body or housing 52 that houses a working fluid 54 that is used to power or drive operation of another system or component (e.g., blowout preventer). The working fluid 54 is stored in a function chamber 56 (e.g., cavity) formed by a first end cap 58 and a piston 60. The first end cap 58 (e.g., housing end cap) defines one or more apertures (e.g., 1, 2, 3, 4, 5 or more) that enable the working fluid to flow through the first end cap 58. To block or reduce formation of a hydraulic lock on the piston 60, the housing 52 includes a balance chamber 64 (e.g., cavity). The balance chamber 64 receives a balance fluid 66 (e.g., oil, hydraulic fluid, water, seawater) that enters the balance chamber 64 as the piston 60 moves in direction 68. The balance chamber 64 may receive the balance fluid 66 through one or more apertures 70 in the housing 52 from an external supply 72 or a fluid surrounding the housing 52 (e.g., seawater). For example, the external supply 72 may store oil, hydraulic fluid, water, etc., which flows through a conduit 74 and into the balance chamber 64. The balance fluid 66 may be pumped into the balance chamber 64 or it may be drawn into the balance chamber 64 by the movement of the piston 60 in direction 68.

The piston 60 moves in directions 68 and 76 in response to an actuator 78 that pulls and pushes the shaft 80 in directions 76 and 68. For example, the actuator 78 may be an electric motor. The actuator 78 may be powered with one or more batteries 81 and/or with electric power supplied from an external power source 82. For example, during operation the battery 81 may power the actuator 78, after which the battery 81 is recharged from an external power source 82. The external power source 82 may couple to the actuator 78 with a cable that extends through the housing 52. The actuator 78 and/or battery 81 rest within an actuator chamber 84 (e.g., cavity) defined by the housing 52. The actuator chamber 84 is separated from the exterior environment and from the balance chamber 64 with a second end cap 86 (e.g., housing end cap) and an enclosure cap 88. As illustrated, the enclosure cap 88 defines an aperture 89 that enables the shaft 80 to couple to the actuator 78.

In order to control the operation of the actuator 78, the accumulator system 50 includes a controller 90. The controller 90 includes a processor 92 and a memory 94. For example, the processor 92 may be a microprocessor that executes software to control operation of the actuator 78. The processor 92 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 92 may include one or more reduced instruction set (RISC) processors.

The memory 94 may include a volatile memory, such as random access memory (RAM), and/or a nonvolatile memory, such as read-only memory (ROM). The memory 94 may store a variety of information and may be used for various purposes. For example, the memory 94 may store processor executable instructions, such as firmware or software, for the processor 92 to execute. The memory 94 may include ROM, flash memory, a hard drive, or any other suitable optical, magnetic, or solid-state storage medium, or a combination thereof. The memory 94 may store data, instructions, and any other suitable data.

Figure 3:
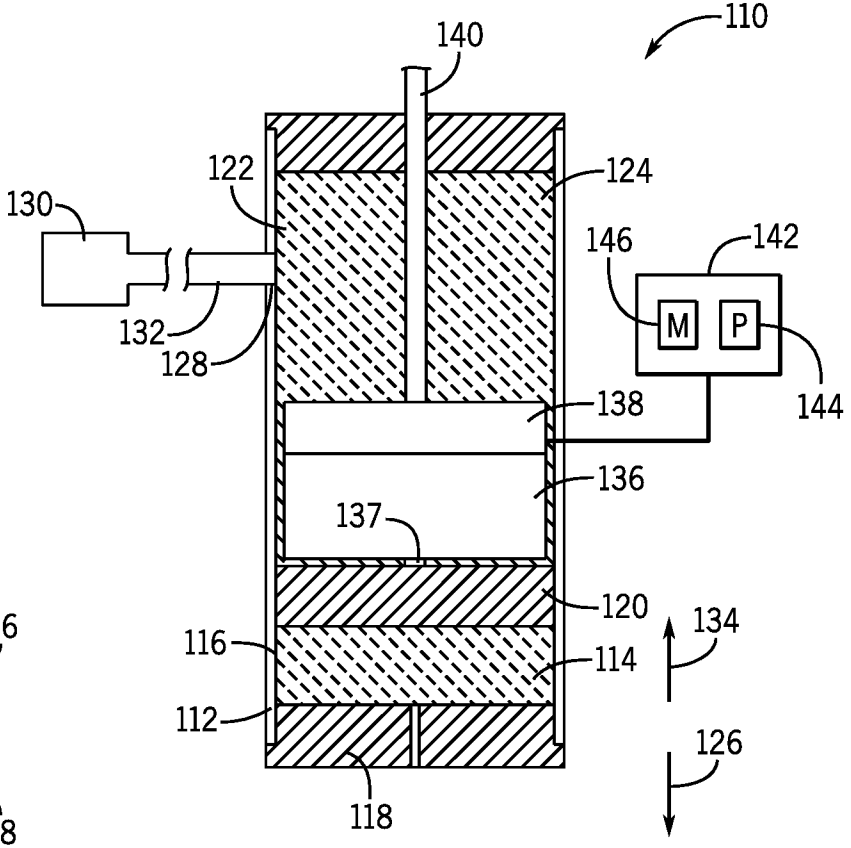
FIG. 3 is a schematic of an accumulator system, in accordance with an embodiment of the present disclosure.

FIG. 3 is a schematic of an accumulator system 110. The accumulator system 110 includes a body or housing 112 that houses a working fluid 114 used to power or drive operation of another system or component (e.g., blowout preventer). The working fluid 114 is stored in a function chamber 116 (e.g., cavity) formed by a first end cap 118 and a piston 120. The first end cap 118 (e.g., housing end cap) defines one or more apertures (e.g., 1, 2, 3, 4, 5 or more) that enable the working fluid to flow through the first end cap 118. To block or reduce formation of a hydraulic lock, the housing 112 includes a balance chamber 122 (e.g., cavity). The balance chamber 122 receives a balance fluid 124 (e.g., oil, hydraulic fluid, water, seawater) that enters the balance chamber 122 as the piston 120 moves in direction 126. The balance chamber 122 may receive the balance fluid 124 through one or more apertures 128 in the housing 112 from an external supply 130 or a fluid surrounding the housing 112 (e.g., seawater). For example, the external supply 130 may store oil, hydraulic fluid, water, etc., which flows through a conduit 132 and into the balance chamber 122. The balance fluid 124 may be pumped into the balance chamber 122 or it may be drawn into the balance chamber 122 by the movement of the piston 120 in direction 126.

The piston 120 moves in directions 126 and 134 in response to an actuator 136 that pulls and pushes the shaft 137 in directions 126 and 134. For example, the actuator 136 may be an electric motor. The actuator 136 may be powered with one or more batteries 138 and/or with electric power supplied from an external power source 140. The external power source 140 may couple to the actuator 136 with a cable that extends through the housing 112. As illustrated, the actuator 136 and/or battery 138 rest within the balance chamber 122 and are therefore surrounded by the balance fluid 124. In order to control operation of the actuator 136, the accumulator system 110 includes a controller 142. The controller 142 includes a processor 144 and a memory 146. For example, the processor 144 may be a microprocessor that executes software stored on the memory 146 to control operation of the actuator 136. The processor 144 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 144 may include one or more reduced instruction set (RISC) processors.

The memory 146 may include a volatile memory, such as random access memory (RAM), and/or a nonvolatile memory, such as read-only memory (ROM). The memory 146 may store a variety of information and may be used for various purposes. For example, the memory 146 may store processor executable instructions, such as firmware or software, for the processor 144 to execute. The memory 146 may include ROM, flash memory, a hard drive, or any other suitable optical, magnetic, or solid-state storage medium, or a combination thereof. The memory 146 may store data, instructions, and any other suitable data.

Figure 4:
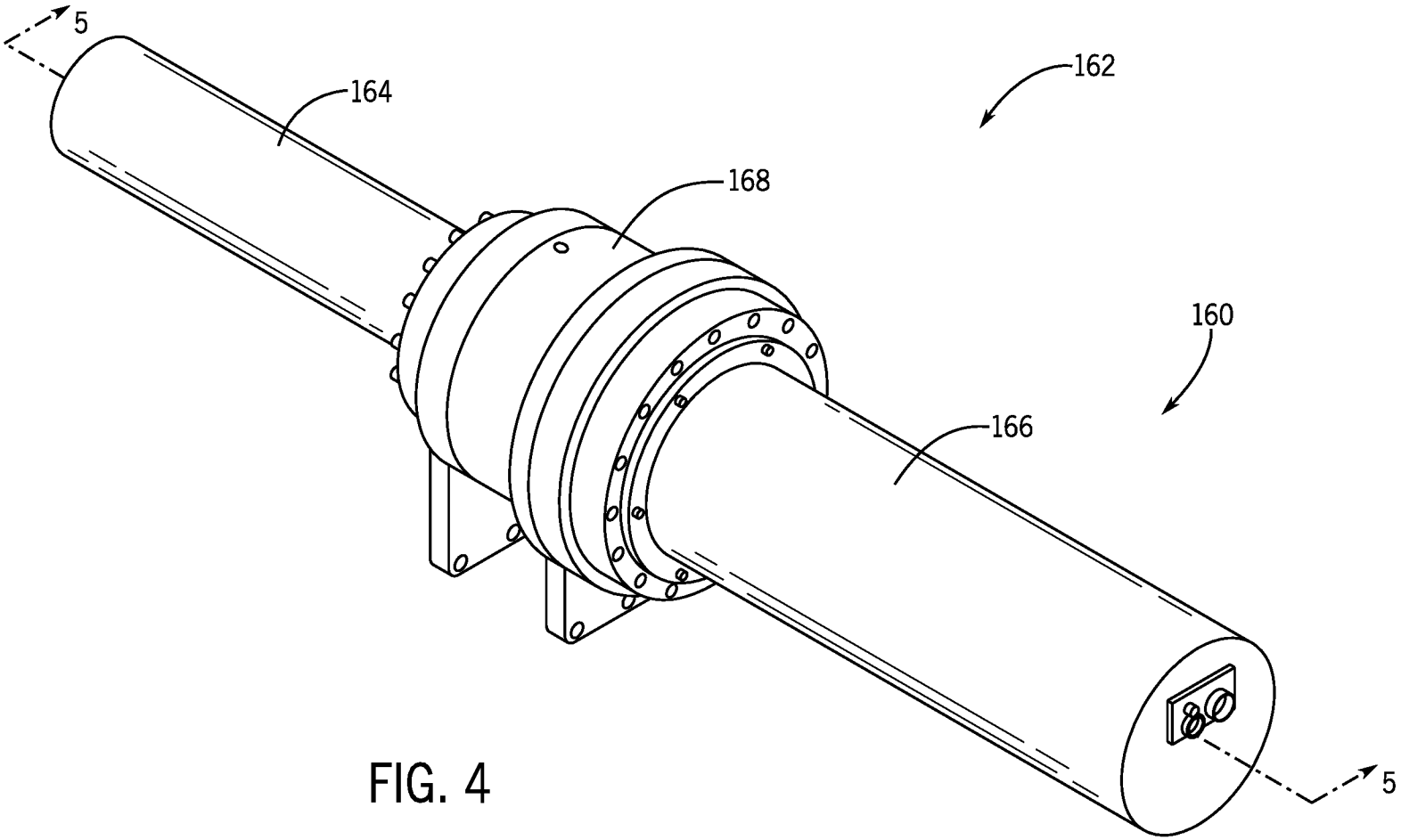
FIG. 4 is a perspective view of an accumulator system, in accordance with an embodiment of the present disclosure.

FIG. 4 is a perspective view of an accumulator system 160 that enables storage of a fluid (e.g., working fluid) at ambient pressure (e.g., ambient pressure in a subsea environment). The accumulator system 160 includes a housing 162. The housing 162 includes a first cylinder 164 and a second cylinder 166 that couple to an actuator housing 168. In operation, the accumulator system 160 enables on demand pressurization of the fluid (e.g., working fluid) in the first cylinder 164. The pressurization of the fluid drives the fluid out of the first cylinder 164 to power or drive operation of another system or component (e.g., blowout preventer). As will be explained below, the second cylinder 166 may house various components that facilitate operation of the accumulator system 160.

Figure 5:
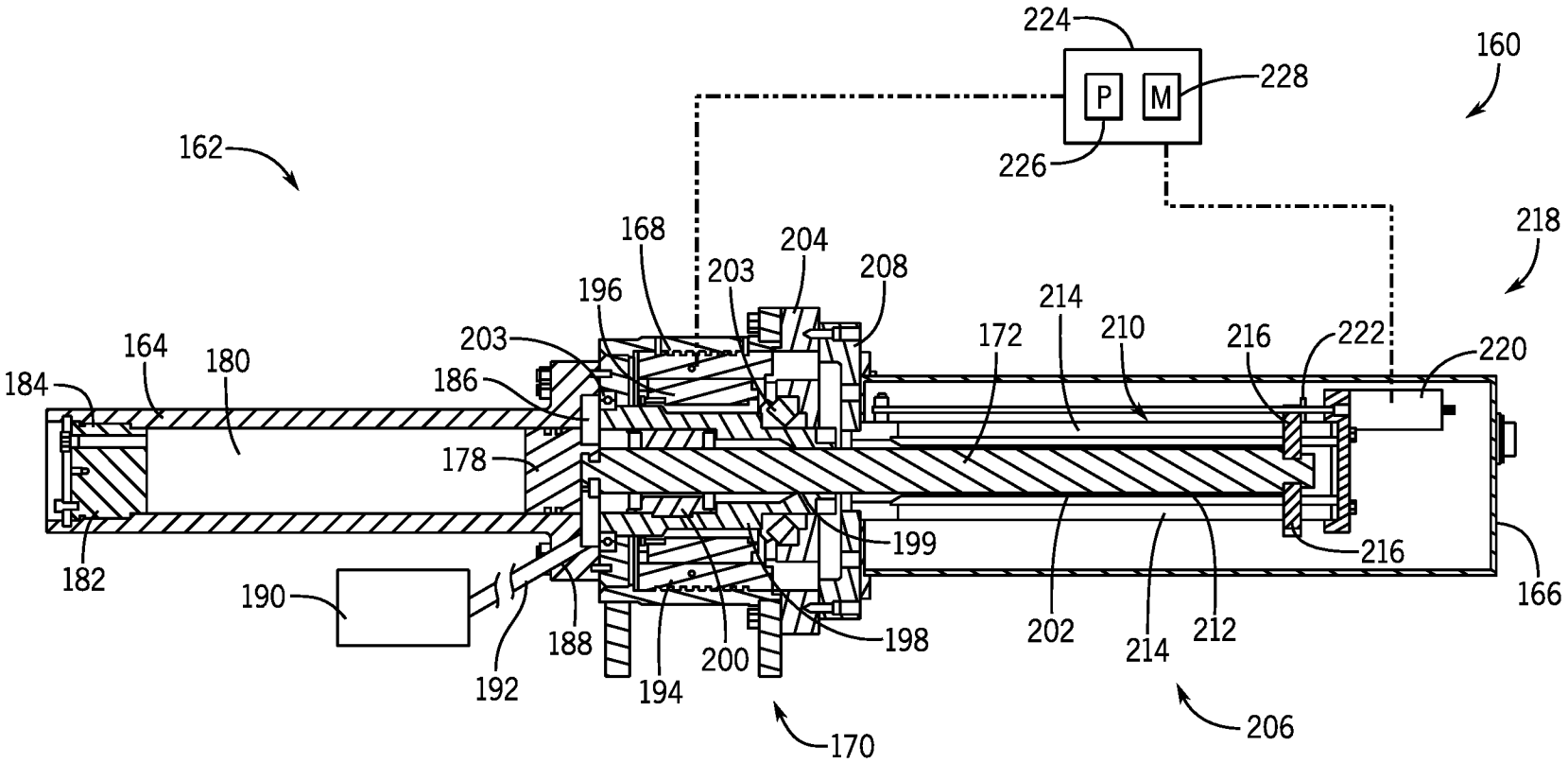
FIG. 5 is a cross-sectional view along line 5-5 in FIG. 4 of the accumulator system in an unactuated state, in accordance with an embodiment of the present disclosure.

FIG. 5 is a cross-sectional view along line 5-5 in FIG. 4 of the accumulator system 160 in an unactuated state. As explained above, the accumulator system 160 includes the first cylinder 164 and the second cylinder 166 that couple to an actuator housing 168. The actuator housing 168 houses an actuator 170 (e.g., electric motor) that drives a shaft 172 in directions 174 and 176 to extend and retract a piston 178. As the piston 178 moves in direction 174, the piston 178 pressurizes a working fluid (e.g., hydraulic fluid) stored in a function chamber 180 (e.g., cavity) of the accumulator system 160. As the working fluid pressurizes, the working fluid exits the accumulator system 160 and flows through the end cap 182. The end cap 182 defines one or more apertures (e.g., 1, 2, 3, 4, 5 or more) that enable the working fluid to flow through the end cap 182.

To block or reduce formation of a hydraulic lock on the piston 178, the first cylinder 164 may include a balance chamber 186 (e.g., cavity). In some embodiments, the actuator housing 168 and the first cylinder 164 may form the balance chamber 186. The balance chamber 186 receives a balance fluid 66 (e.g., oil, hydraulic fluid, water, seawater) that enters the balance chamber 186 as the piston 178 moves in direction 174. The balance chamber 186 may receive the balance fluid through one or more apertures 188 in the first cylinder 164 and/or the actuator housing 168. The balance fluid may be supplied from an external supply 190 or a fluid surrounding the accumulator system 160 (e.g., seawater). For example, the external supply 190 may store oil, hydraulic fluid, water, etc., which flows through a conduit 192 and into the balance chamber 186. The balance fluid may be pumped into the balance chamber 186 or it may be drawn into the balance chamber 186 by the movement of the piston 178 in direction 174.

As illustrated, the actuator 170 is an electric motor with a stator 194 and a rotor 196 that includes magnets (e.g., electromagnets, permanent magnets, combinations of electromagnets and permanent magnets). In operation, the rotor 196 rotates in response to electrical power supplied to the magnets of the stator 194 and/or the rotor 196. As the rotor 196 rotates, the rotor 196 rotates a screw adapter 198. The screw adapter 198 defines an aperture 199 that enables the shaft 172 to extend through the screw adapter 198. In some embodiments, the screw adapter 198 receives a plurality of roller screws 200 in the aperture 199. As the screw adapter 198 rotates, the plurality of roller screws 200 rotate. The rollers screws 200 engage an exterior threaded surface 202 of the shaft 172. As the roller screws 200 rotate they drive the shaft 172 axially in directions 174 and 176. In some embodiments, the screw adapter 198 may define a threaded surface that directly engages the shaft 172 to drive the shaft 172 in axial directions 174 and 176.

To facilitate rotation of the screw adapter 198, the accumulator system 160 may include one or more bearings 203 (e.g., thrust bearings). As illustrated, the bearings 203 may be placed between the screw adapter 198 and the actuator housing 168, as well as between the screw adapter 198 and a retention plate 204. The retention plate 204 couples to the actuator housing 168 to block removal of the stator 194, rotor 196, and screw adapter 198. The retention plate 204 may also hold the bearings 203 in position relative to the screw adapter 198.

In order to block rotation of the shaft 172, the accumulator system 160 may include an anti-rotation system 206. The anti-rotation system 206 may include an anti-rotation flange 208 (e.g., plate) that couples to the retention plate 204. The anti-rotation flange 208 in turn couples to an anti-rotation housing 210 (e.g., cylinder, block). The anti-rotation housing 210 defines a cavity 212 that receives the shaft 172 and one or more slits 214 (e.g., apertures) that receive anti-rotation guides 216. The anti-rotation guides 216 may be protrusions (e.g., integral, one-piece) that extend radially outward from the shaft 172 and/or blocks that extend radially outward from the shaft 172 and that separately couple to the shaft 172. The anti-rotation guides 216 extend into the slits 214 and block rotation of the shaft 172 by contacting the anti-rotation housing 210.

In some embodiments, the accumulator system 160 may include a position detection system 218 that enables detection of the position of the shaft 172. The position detection system 218 includes a position sensor 220 (e.g., magnetic field sensor) that senses the strength of a magnetic field created by a magnet 222. The magnet 222 couples to the anti-rotation guides 216 and therefore moves axially in directions 174 and 176 as the shaft 172 moves. In some embodiments, the anti-rotation guides 216 may be made out of a magnetic material. As the magnet 222 moves in direction 174 the strength of the magnetic field created by the magnet 222 decreases. Likewise, movement of the magnet 222 in direction 176 increases the strength of the magnetic field relative to the position sensor 220. The change in magnetic field strength is sensed by the position sensor 220 and transmitted to a controller 224 as a signal indicative of the detected magnetic field strength. The controller 224 receives this signal and determines the relative position of the magnet 222 relative to the position sensor 220 to determine the position of the shaft 172. In some embodiments, the position detection system 218 may include an ultrasonic sensor that enables detection of changes in the position of the shaft 172. For example, the position sensor 220 may emit a signal that is reflected off a plate coupled to the anti-rotation guides and/or off the anti-rotation guides 216.

The controller 224 includes a processor 226 and a memory 228. For example, the processor 226 may be a microprocessor that executes software stored on the memory 228 to control operation of the accumulator system 160. The processor 226 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 226 may include one or more reduced instruction set (RISC) processors.

The memory 228 may include a volatile memory, such as random access memory (RAM), and/or a nonvolatile memory, such as read-only memory (ROM). The memory 228 may store a variety of information and may be used for various purposes. For example, the memory 228 may store processor executable instructions, such as firmware or software, for the processor 226 to execute. The memory 228 may include ROM, flash memory, a hard drive, or any other suitable optical, magnetic, or solid-state storage medium, or a combination thereof. The memory 228 may store data, instructions, and any other suitable data.

Figure 6:
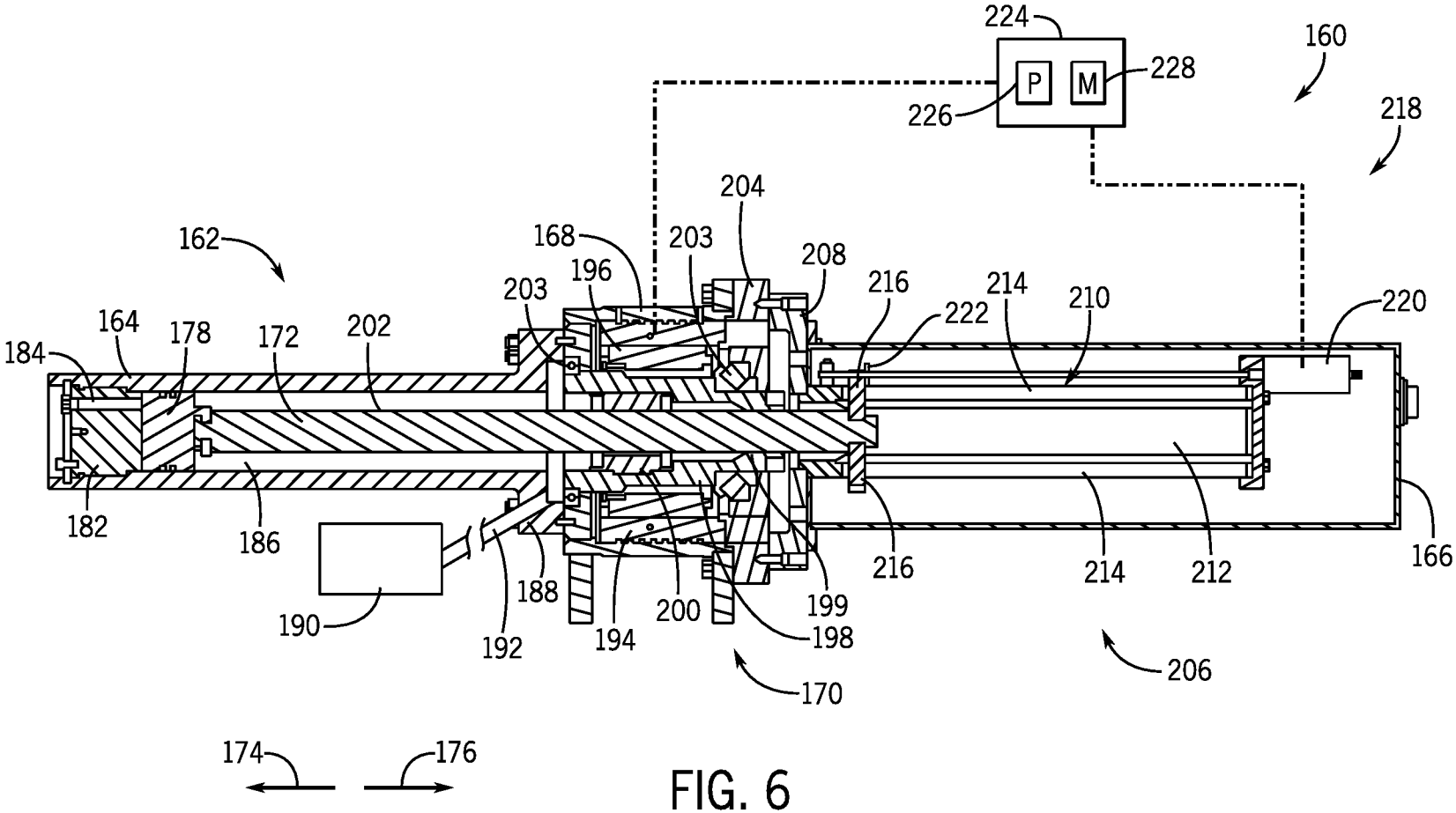
FIG. 6 is a cross-sectional view along line 5-5 in FIG. 4 of the accumulator system in an actuated state, in accordance with an embodiment of the present disclosure.

FIG. 6 is a cross-sectional view along line 5-5 in FIG. 4 of the accumulator system 160 in an actuated state. As explained above, the accumulator system 160 transitions from the unactuated state to the actuated state as the actuator 170 rotates. Rotation of the actuator 170 rotates the screw adapter 198, which rotates the roller screws 200 to drive the shaft 172 in direction 174. As the shaft 172 moves in direction 174, the shaft 172 drives the piston 178. Movement of the piston 178 in direction 174 pressurizes and drives the working fluid out of the accumulator system 160. As the working fluid exits, the working fluid may actuate a mineral extraction system and/or component.

Figure 7:
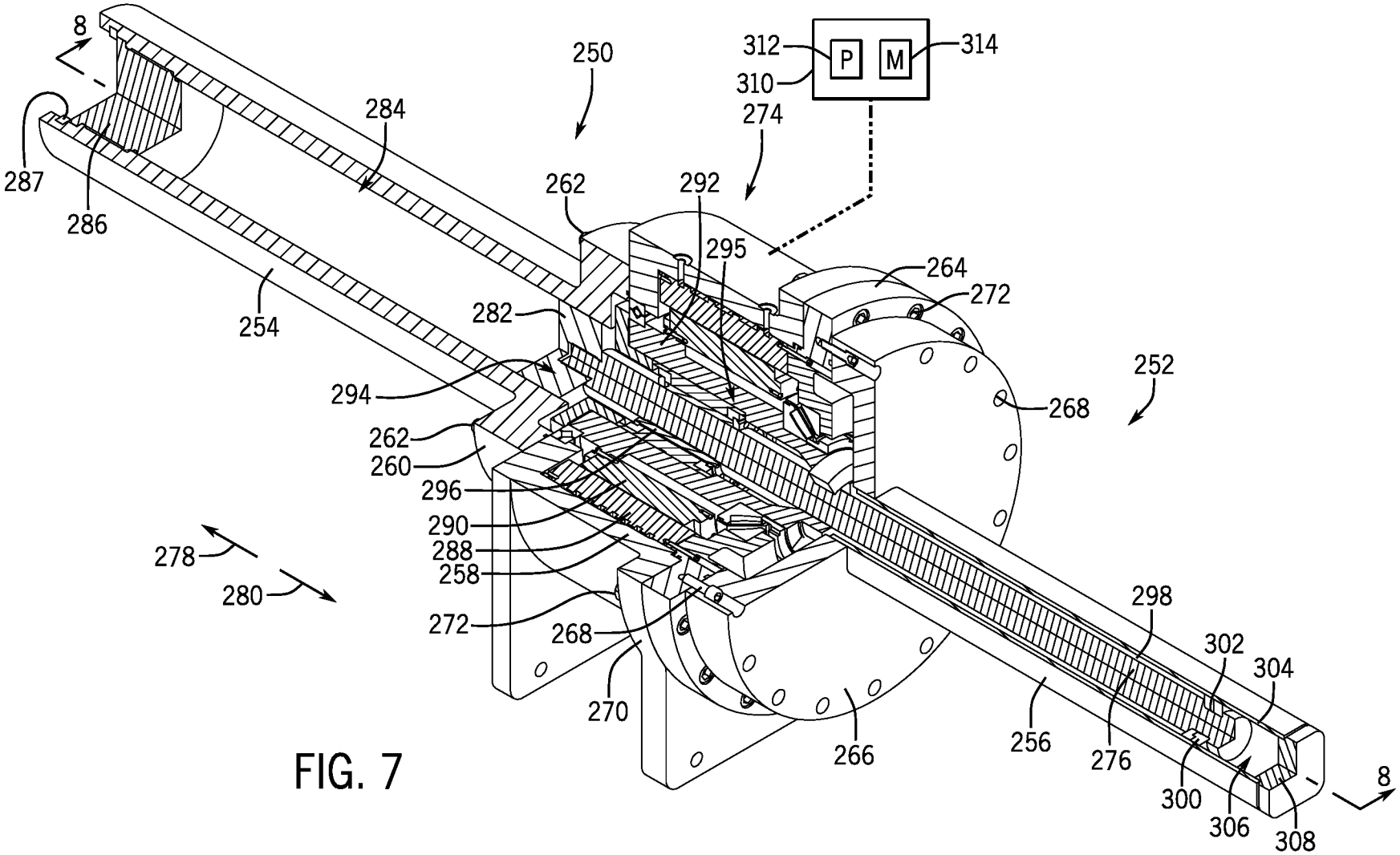
FIG. 7 is a partial perspective cross-sectional view of an accumulator system, in accordance with an embodiment of the present disclosure.

FIG. 7 is a partial perspective cross-sectional view of an accumulator system 250 that pressurizes fluid for other equipment (e.g., blowout preventer). The FIG. 7 the accumulator system 250 is an unactuated state. The accumulator system 250 includes a housing 252 with a piston housing 254 (e.g., first cylinder) and a shaft housing 256 (e.g., second cylinder) that couple to an actuator housing 258. In some embodiments, the piston housing 254 may couple directly to the actuator housing 258 with a flange 260 and bolts 262. The shaft housing 256 may couple to a bearing retainer 264 (e.g., thrust bearing retainer) with flange 266 and bolts 268. The bearing retainer 264 in turn couples to flange 270 of the actuator housing 258 with bolts 272.

The actuator housing 258 houses an actuator 274 (e.g., electric motor) that drives a shaft 276 in directions 278 and 280 to extend and retract a piston 282. As the piston 282 moves in direction 278, the piston 282 pressurizes a working fluid (e.g., hydraulic fluid) in a chamber 284 (e.g., cavity) of the piston housing 254. The pressurized fluid then exits the accumulator system 250 through an end cap 286 (e.g., plug). The end cap 286 defines one or more apertures (e.g., 1, 2, 3, 4, 5 or more) that enable the working fluid to flow through the end cap 286. In some embodiments, a C-ring 287 may retain the end cap 286 within the piston housing 254.

To block or reduce the formation of a hydraulic lock on the piston 282, the accumulator system 250 may draw fluid (e.g., balance fluid) into the piston housing 254. For example, the accumulator system 250 may use the negative pressure created by the piston 282 moving in direction 278 to draw fluid into the piston housing 254 behind the piston 282 in the direction of travel. The balance fluid may be oil, hydraulic fluid, water, seawater, among others. The accumulator system 250 may receive the balance fluid through one or more apertures in the housing 252.

As illustrated, the actuator 274 is an electric motor with a stator 288 and a rotor 290 that includes magnets (e.g., electromagnets, permanent magnets, combinations of electromagnets and permanent magnets). In operation, the rotor 290 rotates in response to electrical power supplied to the magnets of the stator 288 and/or the rotor 290. As the rotor 290 rotates, the rotor 290 rotates a screw adapter 292. For example, the rotor 290 may couple to the screw adapter 292 with one or more bolts 293. The screw adapter 292 defines an aperture 294 that enables the shaft 276 to extend through the screw adapter 292. In some embodiments, the screw adapter 292 receives a nut assembly 295 (e.g., planetary roller screw) in the aperture 294. The nut assembly 295 includes a plurality of roller screws 296 that engage the shaft 276. As the screw adapter 292 rotates, the plurality of roller screws 296 engage an exterior threaded surface 298 of the shaft 276. As the roller screws 296 rotate they drive the shaft 276 axially in directions 278 and 280.

In order to block rotation of the shaft 276, the accumulator system 250 includes anti-rotation caps or blocks 300 (e.g., 1, 2, 3, 4, 5, 6) that couple to a groove 302 (e.g., notch) on the shaft 276. The anti-rotation blocks 300 are non-circular (e.g., square, rectangular, ovular) and are configured to contact an interior surface 304 of the shaft housing 256 to block rotation of the shaft 276. As illustrated, cross-sectional shape of the cavity 306 defined by the interior surface 304 is non-circular (e.g., square, rectangular, ovular). Accordingly, placement of non-circular anti-rotation blocks 300 in a non-circular cavity 306 enables the shaft housing 256 to block rotation of the shaft 276. In some embodiments, the accumulator system 250 may include an end cap 308 that seals the shaft housing 256 and the shaft 276 in the accumulator system 250.

In order to control the actuator 274, the accumulator system 250 includes a controller 310. The controller 310 includes a processor 312 and a memory 314. For example, the processor 312 may be a microprocessor that executes software stored on the memory 314 to control operation of the accumulator system 250. The processor 312 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 312 may include one or more reduced instruction set (RISC) processors.

The memory 314 may include a volatile memory, such as random access memory (RAM), and/or a nonvolatile memory, such as read-only memory (ROM). The memory 314 may store a variety of information and may be used for various purposes. For example, the memory 314 may store processor executable instructions, such as firmware or software, for the processor 312 to execute. The memory 314 may include ROM, flash memory, a hard drive, or any other suitable optical, magnetic, or solid-state storage medium, or a combination thereof. The memory 314 may store data, instructions, and any other suitable data.

FIG. 8 is a cross-sectional view of the accumulator system 250 of FIG. 7 along line 8-8. As explained above, the actuator 274 rotates the nut assembly 295 with the screw adapter 292. To facilitate rotation of the screw adapter 292, the accumulator system 250 may include bearings 328. For example, the accumulator system 250 may include bearing 330 (e.g., thrust bearing) and bearing 332 (e.g., thrust bearing).

The bearing 330 couples to the screw adapter 292 and rests within a groove 334 (e.g., circumferential groove) of the screw adapter 292 where it contacts a ledge 336 (e.g., circumferential ledge). For example, the bearing 330 may extend circumferentially about the screw adapter 292 within the groove 334. The bearing 330 also rests within a groove 338 (e.g., circumferential groove) in the bearing retainer 264. In this way, the screw adapter 292 and the bearing retainer 264 capture and hold the bearing 330 in place.

The bearing 332 similarly rests within a groove 340 (e.g., circumferential groove) of the screw adapter 292 and within a groove 342 (e.g., circumferential groove) of the actuator housing 258. The bearing 332 is held within the groove 340 with the inner bearing retainer 344 and within the groove 342 with the flange 260 of the piston housing 254. In this way, the accumulator system 250 blocks or reduces both axial and radial movement of the bearings 330 and 332. In some embodiments, the inner bearing retainer 344 may also retain the nut assembly 295 within the screw adapter 292. In this way, the screw adapter 292 and bearings 330 and 332 enable the screw adapter 292 to rotate while simultaneously blocking or reducing movement of the nut assembly 295 and actuator 274.

FIG. 9 is a partial cross-sectional view of the accumulator system 250 within line 9-9 of FIG. 8. As illustrated, the inner bearing retainer 344 couples to the screw adapter 292 with one or more bolts 360. In some embodiments, the bolts 360 may be evenly spaced (e.g., circumferentially) about the inner bearing retainer 344 to evenly distribute axial force between the bearing 332, the screw adapter 292, and the inner bearing retainer 344. But it should be also understood that in some embodiments, the bolts 360 may not be evenly distributed.

Figure 10:
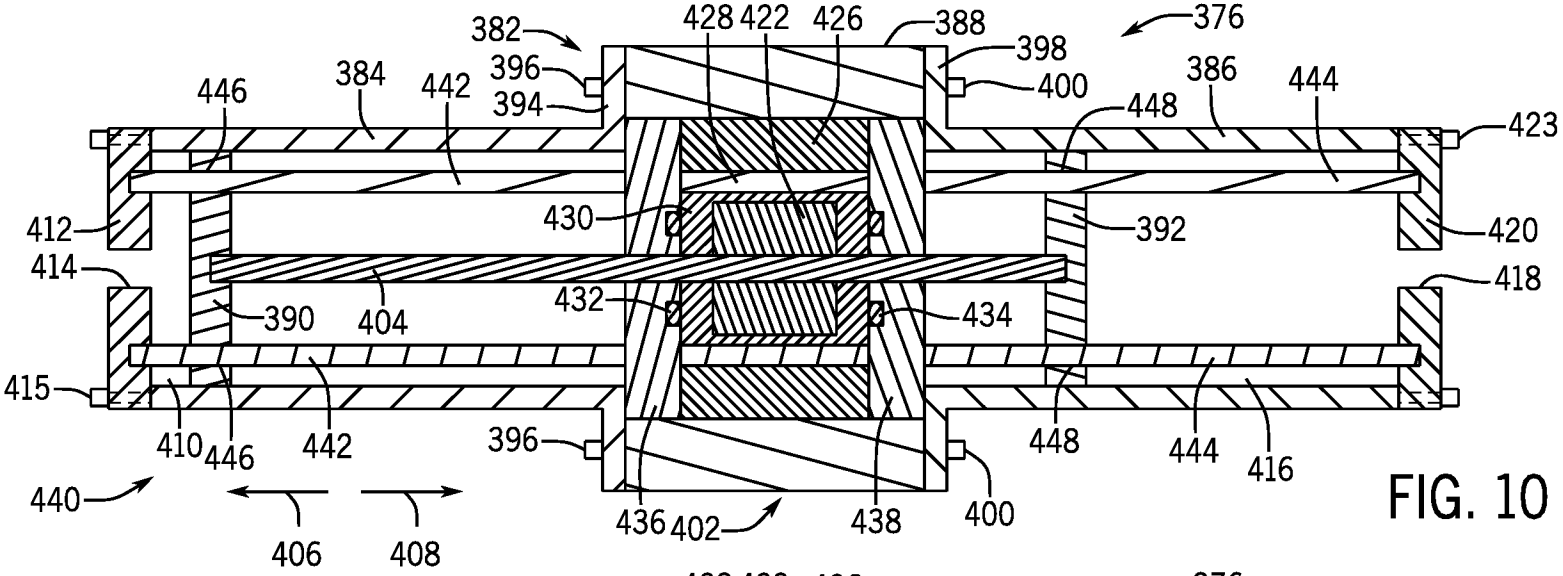
FIG. 10 is a cross-sectional view of an accumulator system with a first piston in an extended position and a second piston in a retracted position, in accordance with an embodiment of the present disclosure.

FIG. 10 is a cross-sectional view of a double acting accumulator system 376 capable of discharging a pressurized fluid with a first piston 390 while simultaneously drawing fluid in with a second piston 392. After discharging the pressurized fluid with the first piston 390, the double acting accumulator system 376 uses the second piston 392 to pressurize fluid as the first piston 390 draws fluid in. The first and second pistons 390, 392 are housed within a housing 382. The housing 382 includes a first piston housing 384 (e.g., first cylinder) and a second piston housing 386 (second cylinder) that couple to an actuator housing 388. The first piston 390 is housed in the first piston housing 384 and the second piston 392 is housed in the second piston housing 386. The first piston housing 384 may couple directly to the actuator housing 388 with a flange 394 and one or more fasteners 396 (e.g., bolts). The second piston housing 386 may similarly couple to the actuator housing 388 with a flange 398 and bolts 400.

The actuator housing 388 houses an actuator 402 (e.g., electric motor) that drives a shaft 404 in directions 406 and 408 to extend and retract the first and second pistons 390, 392. As the shaft moves in direction 406, the first piston 390 pressurizes a first working fluid (e.g., hydraulic fluid) in a chamber 410 (e.g., cavity) of the first piston housing 384. The pressurized fluid then exits the double acting accumulator system 376 and flows through a first end cap 412 (e.g., plug). The first end cap 412 defines one or more apertures 414 (e.g., 1, 2, 3, 4, 5 or more) that enable the working fluid to flow through the first end cap 412. The first end cap 412 may couple to the first piston housing 384 with one or more fasteners 415 (e.g., bolts). In addition, as the shaft moves in direction 406, the second piston 392 retracts or moves in direction 406 drawing a second working fluid into a chamber 416 (e.g., cavity) of the second piston housing 386. The fluid is drawn into the chamber 416 through one or more apertures 418 (e.g., 1, 2, 3, 4, 5 or more) in a second end cap 420 (e.g., plug). As illustrated, the second end cap 420 may couple to the second piston housing 386 with one or more fasteners 423 (e.g., bolts).

The actuator 402 drives the shaft 404 with a nut assembly 422 (e.g., planetary roller screw) that couples to a threaded exterior surface of the shaft 404. The nut assembly 422 rotates in response to actuation of the actuator 402. The actuator 402 includes a stator 426 and a rotor 428 that rotates relative to the stator 426. In some embodiments, the rotor 428 may not couple directly to the nut assembly 422. Instead, the rotor 428 may couple to an adapter 430 (e.g., screw adapter). Rotation of the rotor 428 then rotates the adapter 430, which in turn rotates the nut assembly 422. To facilitate rotation and maintain alignment of the actuator 402, adapter 430, and nut assembly 422, the double acting accumulator system 376 may include bearings 432 and 434. In some embodiments, these bearings 432 and 434 may be radial thrust bearings. The bearings 432 and 434 are held in place with respective first and second bearing adapters 436 and 438.

To block rotation of the shaft 404, the double acting accumulator system 376 includes an anti-rotation system 440. The anti-rotation system 440 includes anti-rotation shafts 442 and 444 (e.g., rods) which block rotation of the respective first and second pistons 390 and 392. The first and second pistons 390 and 392 in turn block rotation of the shaft 404. These anti-rotation shafts 442 and 444 rest within the respective first and second piston housing 384 and 386. As illustrated, the anti-rotation shafts 442 and 444 extend through respective apertures 446 and 448 in the first and second pistons 390 and 392. In some embodiments, by including two or more anti-rotation shafts for each piston the anti-rotation shafts are able to block rotation of the pistons 390, 392. In some embodiments, the anti-rotation system 440 may include a single anti-rotation shaft 442 and 444 that blocks rotation of the respective first and second pistons 390 and 392. For example, the anti-rotation shafts 442 and 444 may define a non-circular cross-section that passes through corresponding apertures 446 and 448 in the first and second pistons 390 and 392. The non-linear cross-section blocks the first and second pistons 390 and 392 from rotating relative to the anti-rotation shafts 442 and 444. In some embodiments, the anti-rotation shafts 442 and 444 couple to the respective end caps 412 and 414 as well as the respective first and second bearing adapters 436 and 438.

Figure 11:
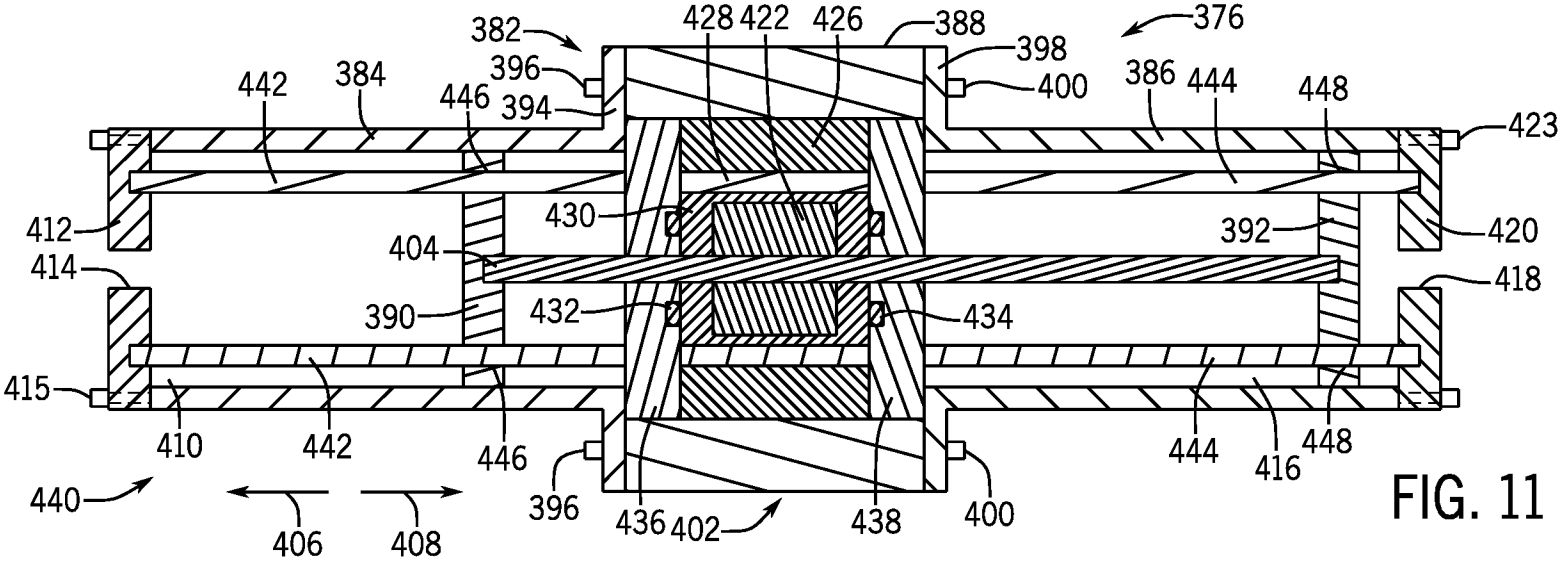
FIG. 11 is a cross-sectional view of the accumulator system of FIG. 10 with the first piston in the retracted position and a second piston in the extended position, in accordance with an embodiment of the present disclosure.

FIG. 11 is a cross-sectional view of the double acting accumulator system 376 of FIG. 10. As explained above, FIG. 10 illustrates the first piston 390 in the extended position driving pressurized fluid out of the first piston housing 384 and the second piston 392 in a retracted position enabling fluid to enter the second piston housing 386. After driving the pressurized fluid out of the first piston housing 384 and filling the second piston housing 386, the actuator 402 rotates in the opposite direction to rotate the nut assembly 422 in the opposite direction. As the nut assembly 422 rotates in the opposite direction, the shaft 404 is driven in direction 408 to pressurize and drive the fluid out of the second piston housing 386 with the second piston 392. As the second piston 392 moves in direction 408, the first piston 390 retracts enabling fluid to fill the first piston housing 384. In this way, the double acting accumulator system 376 may continuously provide pressurized fluid for use by equipment.

Figure 12:
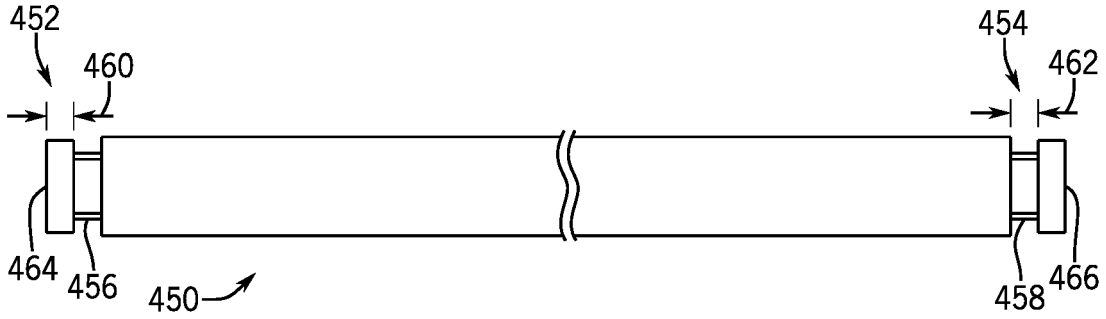
FIG. 12 is a side view of a shaft of an accumulator system, in accordance with an embodiment of the present disclosure.

FIG. 12 is a side view of a shaft 450 for an accumulator system (e.g., a double acting accumulator system). The shaft 450 defines first and second ends 452, 454. At each of these ends 452, 454 there are respective grooves 456 and 458 (e.g., circumferential grooves). These grooves 456 and 458 are respective distances 460 and 462 from first and second distal ends 464, 466 of the shaft 450. As will be explained below, these grooves 456 and 458 enable the shaft 450 to couple to anti-rotation blocks that interact with anti-rotation shafts (e.g., anti-rotation shafts 442, 444) to block rotation of the shaft 450.

Figure 13:
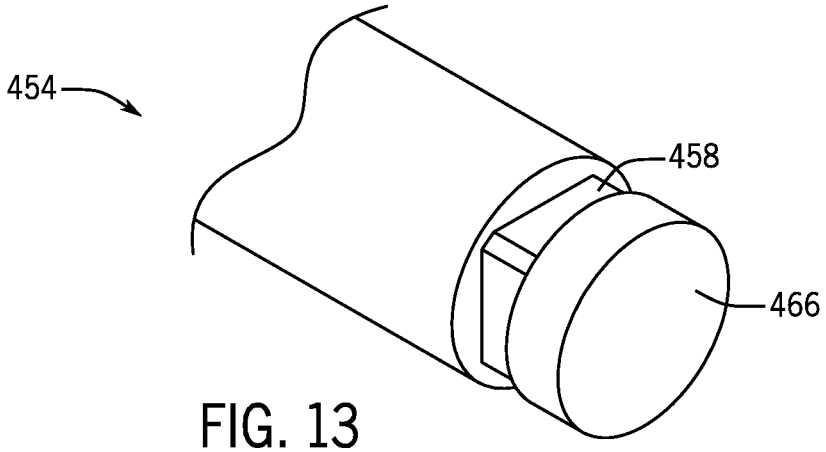
FIG. 13 is a partial perspective view of a shaft of an accumulator system in accordance with an embodiment of the present disclosure.

FIG. 13 is a partial perspective view of the end 454 of the shaft 450 in FIG. 12. As illustrated, the profile of the groove 458 may be non-circular (e.g., square, rectangular, ovular). In operation, the non-circular profile blocks or reduces rotation of a piston coupled to the shaft 450 through interaction with anti-rotation blocks.

Figure 14:
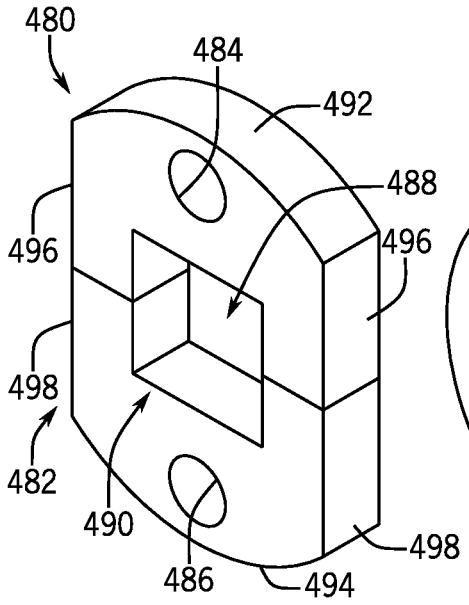
FIG. 14 is a perspective view of anti-rotation blocks of an accumulator system, in accordance with an embodiment of the present disclosure.

FIG. 14 is a perspective view of anti-rotation blocks 480 and 482. The anti-rotation blocks 480 and 482 define respective apertures 484 and 486 and grooves 488 and 490. The apertures 484 and 486 enable anti-rotation shafts (e.g., anti-rotation shafts 444 or 446) to extend through and couple to a piston, while the grooves 488 and 490 enable the anti-rotation blocks 480 and 482 to engage the groove 456 or 458 of the shaft 450. As illustrated, the grooves 488 and 490 of the anti-rotation blocks 480 and 482 correspond to and are configured to mate with the profile of the grooves 456 and/or 458. In some embodiments, the anti-rotation blocks 480 and 482 define respective curvilinear surfaces 492 and 494. These curvilinear surfaces 492 and 494 may match the curvature of an exterior piston surface. The anti-rotation blocks 480 and 482 may also include linear or straight side surfaces 496 and 498. As will be explained below, these side surfaces 496 and 498 are configured to contact corresponding surfaces of a piston to block the piston from rotating relative to the anti-rotation blocks 480, 482, and thus relative to the shaft 450.

Figure 15:
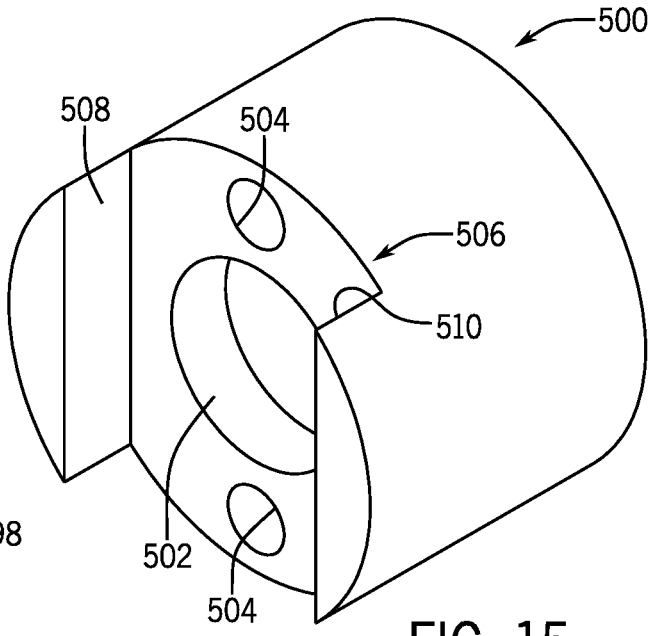
FIG. 15 is a perspective view of a piston of an accumulator system, in accordance with an embodiment of the present disclosure.

FIG. 15 is a perspective view of a piston 500. The piston 500 is configured to couple to the shaft 450, the anti-rotation blocks 480, 482, and to anti-rotation shafts. In order to couple to the shaft 450, the piston 500 defines an aperture 502 (e.g., threaded aperture). This aperture 502 may be centered in the piston 500. Offset from the aperture 502 are apertures 504. These apertures 504 enable the piston 500 to couple to anti-rotation shafts described above. In order to block rotation of the piston 500 relative to the shaft 450, the piston 500 defines a groove 506. The groove 506 receives the anti-rotation blocks 480 and 482 described above. Once the anti-rotation blocks 480 and 482 couple to the piston 500 within the groove 506, the side surfaces 496 and 498 contact the surfaces 508 and 510 that define the groove 506. The interaction between the side surfaces 496 and 498 and the surfaces 508 and 510 blocks the piston 500 from rotating relative to the anti-rotation blocks 480, 482. The anti-rotation blocks 480 and 482 in turn block the shaft 450 from rotating relative to the piston 500 by interacting with the non-circular profile grooves 488 and 490 on the shaft 450.

Figure 16:
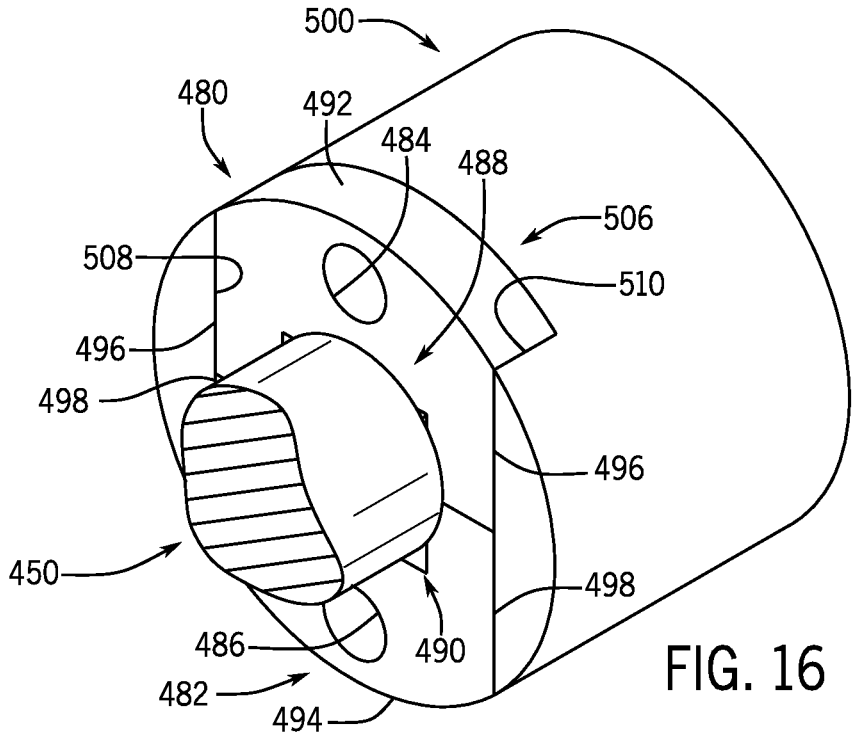
FIG. 16 is a perspective view of the shaft in FIG. 13, retention blocks in FIG. 14, and piston in FIG. 15 of an accumulator system coupled together, in accordance with an embodiment of the present disclosure.

FIG. 16 is a perspective view of the shaft 450 in FIG. 13, anti-rotation blocks 480 and 482 in FIG. 14, and piston 500 in FIG. 15 coupled together. As explained above, when the anti-rotation shafts (e.g., anti-rotation shafts 442 and 444) couple to and block rotation of the piston 500, the piston 500 is able to block rotation of the shaft 450 through the connection of the anti-rotation blocks 480 and 482.

Figure 17:
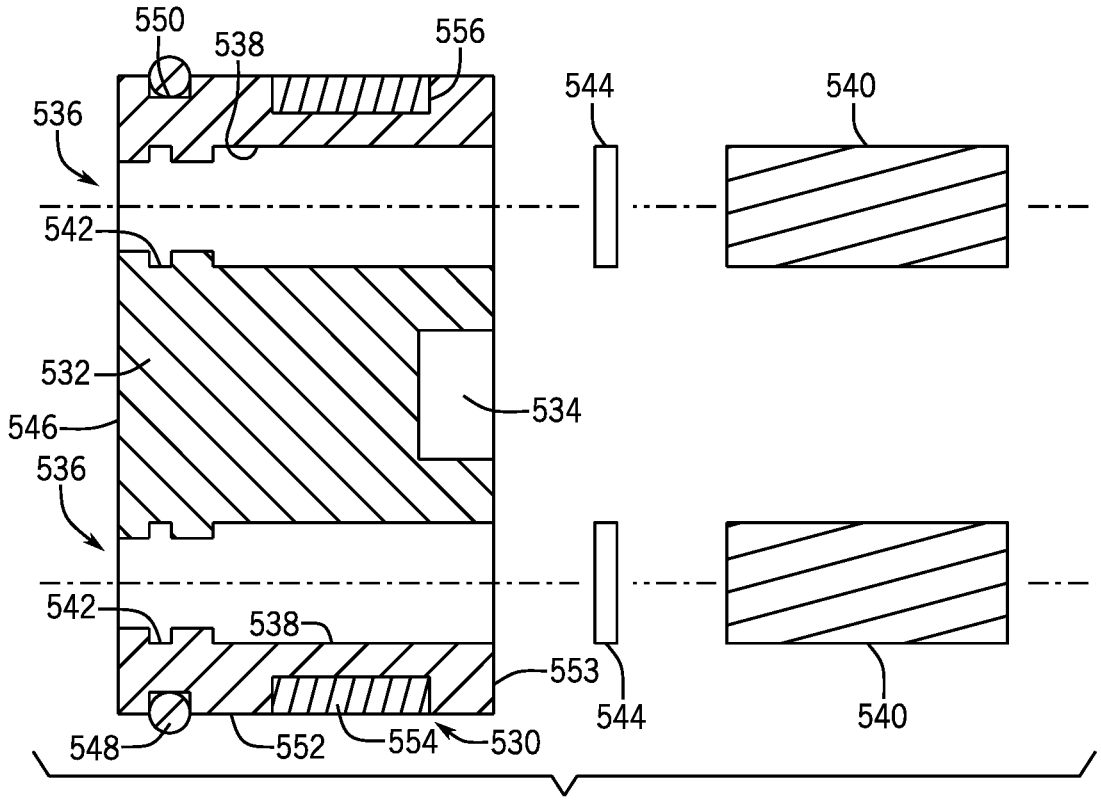
FIG. 17 is a cross-sectional view of a piston of an accumulator system, in accordance with an embodiment of the present disclosure.

FIG. 17 is a cross-sectional view of a piston 530. The piston 530 includes a body 532 that defines one or more apertures 534 and 536 that enable the piston 530 to couple to a driving shaft (e.g., shaft 404) as well as anti-rotation shafts (e.g., anti-rotation shafts 442, 444). The aperture 534 enables a driving shaft to couple to and drive the piston 530 axially. For example, the body 532 may be threaded about the aperture 534 enabling a driving shaft to threadingly couple to the piston 530. The apertures 536 (e.g., 1, 2, 3, 4, 5 or more) enable the piston 530 to receive and slide over anti-rotation shafts. To facilitate sliding, the body 532 may define counterbores 538 that enable the piston 530 to receive bushings 540 (e.g., plastic rod bushings). The bushings 540 may reduce friction between the piston 530 and the anti-rotation shafts enabling the piston 530 to slide over the anti-rotation shafts. To form a seal with the anti-rotation shafts, the body 532 may define one or more grooves 542 that receive seals 544. The seals 544 form a seal between the piston 530 and the anti-rotation shafts during operation. In some embodiments, the grooves 542 are between a face (e.g., front face 546) of the piston 530 and the counterbores 538. To form a seal with a housing (e.g., first or second piston housings 384, 386) surrounding the piston 530, the piston 530 may include one or more seals 548 (e.g., circumferential seals) that rest within corresponding grooves 550 in an exterior surface 552 of the body 532. These seals 548 engage an interior surface of the housing to block or reduce fluid flow between the front face 546 and the rear face 553 of the piston 530. In some embodiments, the piston 530 may also include one or more glide rings 554 (e.g., 1, 2, 3, 4, or more) that extend circumferentially about the piston 530. The glide rings 554 may rest within corresponding grooves 556 (e.g., circumferential grooves). In operation, the glide rings 554 may reduce friction between the piston 530 and the surrounding housing, which may facilitate operation of an accumulator system.

Technical effects of the disclosed embodiments include an accumulator system that does not rely on pressurized gas to provide power to a working fluid. The accumulator system may therefore not experience a loss in efficiency due to water depth. The accumulator system may also vary pressure output since the electric actuator may be controlled in response to pressure demands of the mineral extraction system or component.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An accumulator system, comprising:
a chamber configured to receive a first fluid;
a piston configured to move within the chamber to pressurize and drive the first fluid out of the chamber,
wherein the piston comprises a body defining: a first aperture; and a plurality of counterbores,
a driving shaft coupled to the piston via the first aperture;
a screw adapter coupled to the driving shaft;
a plurality of anti-rotation shafts; and
an electric actuator configured to couple to the screw adapter, wherein the electric actuator is configured to rotate the screw adapter to axially move the driving shaft,
wherein the piston is configured to slide over the plurality of anti-rotation shafts via the plurality of counterbores.

2. The accumulator system of claim 1, further comprising a shaft housing configured to receive the driving shaft.

3. The accumulator system of claim 2, further comprising an anti-rotation block, wherein the anti-rotation block is configured to contact the shaft housing to block rotation of the driving shaft.

4. The accumulator system of claim 1, further comprising a plurality of bearings that enable rotation of the screw adapter.

5. The accumulator system of claim 1, further comprising a plurality of roller screws configured to couple directly to a threaded exterior surface of the driving shaft and to the screw adapter, wherein the roller screws are configured to transfer rotation of the screw adapter to the shaft.

6. The accumulator system of claim 1, further comprising an actuator housing coupled to the chamber, wherein the electric actuator is housed in the actuator housing.

7. A method, comprising:
coupling an accumulator system to a mineral extraction component, the accumulator system comprising:
a housing;
a piston separating the housing into a first chamber and a second chamber;
an electric actuator;
a shaft coupled to the piston and to the electric actuator; and
an anti-rotation system comprising at least one anti-rotation guide that blocks rotation of the shaft;
storing a first fluid in the first chamber at ambient pressure;
rotating the electric actuator, creating rotary motion;
transforming the rotary motion into linear motion of the shaft, which drives the piston;
pressurizing the first fluid and driving the first fluid out of the accumulator system using the piston; and
actuating the mineral extraction component using the first fluid.

8. The method of claim 7, wherein the shaft is coupled to the electric actuator with a screw adapter.

9. The method of claim 8, wherein the step of transforming the rotary motion further comprises: rotating the screw adapter to drive the piston axially.

10. The method of 7, wherein the anti-rotation system further comprises:
an anti-rotation housing defining a cavity,
wherein the shaft is received in the cavity of the anti-rotation housing.

11. The method of claim 7, wherein the anti-rotation system further comprises:
an anti-rotation housing that receives the shaft,
wherein the at least one anti-rotation guide blocks rotation of the shaft by contacting the anti-rotation housing.

12. The method of claim 7, wherein the anti-rotation system further comprises:
an anti-rotation housing defining a cavity and at least one slit;
wherein the shaft is received in the cavity of the anti-rotation housing, and
wherein the at least one anti-rotation guide extends into the at least one slit to block rotation of the shaft by contacting the anti-rotation housing.

13. The method of claim 7, wherein the accumulator system further comprises: a nut assembly coupled to the shaft and to the electric actuator.

14. The method of claim 13, wherein the step of transforming the rotary motion further comprises: rotating the nut assembly to drive the shaft axially.

15. The method of claim 14, wherein the nut assembly comprises a planetary roller screw.

16. The method of claim 14, wherein the nut assembly couples to the electric actuator with a screw adapter, and wherein rotation of the screw adapter is configured to rotate the nut assembly.

17. The method of claim 7, wherein the mineral extraction component is a blowout preventer.

18. A method comprising:
coupling an accumulator system to a mineral extraction component, the accumulator system comprising:
a housing:
a piston separating the housing into a first chamber and a second chamber;
an electric actuator;
a shaft coupled to the piston and to the electric actuator; and
an anti-rotation system;
storing a first fluid in the first chamber at ambient pressure;
rotating the electric actuator, creating rotary motion;

transforming the rotary motion into linear motion of the shaft, which drives the piston;

pressurizing the first fluid and driving the first fluid out of the accumulator system using the piston; and actuating the mineral extraction component using the first fluid, wherein the anti-rotation system comprises a plurality of anti-rotation shafts configured to block rotation of the shaft.

19. The method of claim 18, wherein the piston comprises a body defining: a first aperture; and a plurality of counterbores, wherein the shaft is coupled to the piston via the first aperture, and wherein the piston is configured to slide over the plurality of anti-rotation shafts via the plurality of counterbores.

* * * * *